United States Patent [19]

Beauplat

[11] 3,951,026

[45] Apr. 20, 1976

[54] PUNCHING AND NIBBLING DEVICE FOR A PRESS HAVING A TURRET

[76] Inventor: Philippe L. Beauplat, 44, rue de Montmorency, 95230 Soisy-sous-Montmorency, France

[22] Filed: Sept. 9, 1974

[21] Appl. No.: 504,145

[30] Foreign Application Priority Data

Sept. 13, 1973 France ..... 73.32969

[52] U.S. Cl. ..... 83/552; 83/917; 83/698

[51] Int. Cl.[2] ..... B21D 37/04

[58] Field of Search ..... 83/552, 917, 684, 685, 83/698

[56] References Cited

UNITED STATES PATENTS 3,449,991 6/1969 Daniels ..... 83/552 X

*Primary Examiner*—J. M. Meister

*Attorney, Agent, or Firm*—Bucknam and Archer

[57] ABSTRACT

A punching and nibbling press with a rotatable turret comprised by an upper and a lower horizontal plate vertically spaced apart, and each formed with housings which in the upper plate receive punch members and in the lower plate receive die members corresponding with the punch members. Each set of housings is arranged in a ring shaped array about the axis of rotation of the turret. The housings are of large, medium and small relative sizes so that large, medium and small punch members can be fitted in the respective housings in the upper plate, and large, medium and small die members in the housings in the lower plate. When at least one of the large punch members is not required and additional small punch members are needed, a large punch member is removed from its housing and is replaced by an intermediate member formed with two small housings to receive two small punch members. Likewise, the corresponding large die member is removed from its housing and is replaced by another intermediate member formed with two small housings to receive two small die members.

3 Claims, 3 Drawing Figures

PUNCHING AND NIBBLING DEVICE FOR A PRESS HAVING A TURRET

Figure 1:
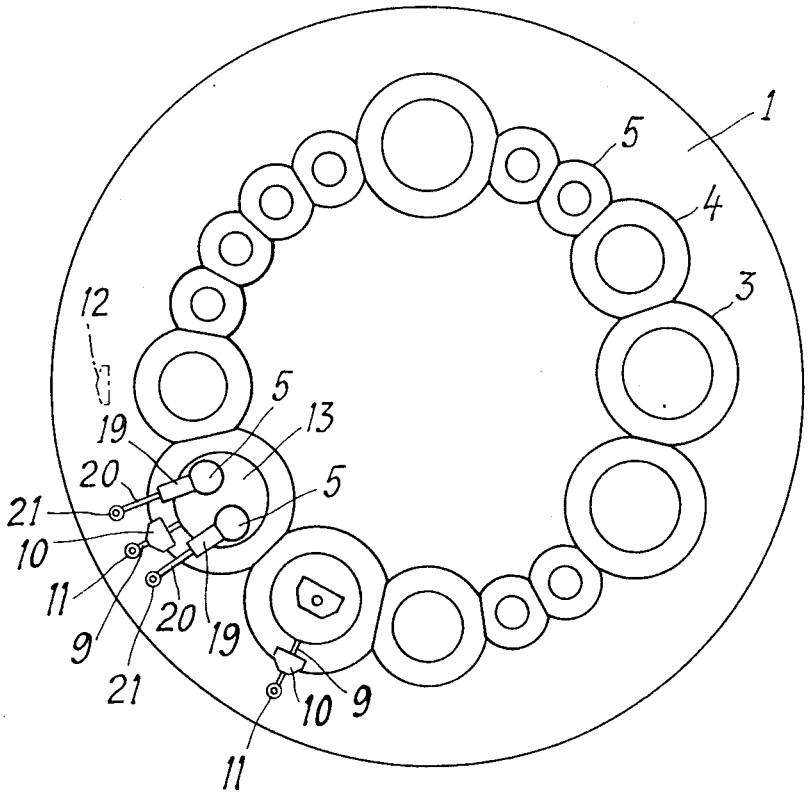

The present invention relates to an improved punching and nibbling device for a press comprising a turret.

Turret presses comprise a frame generally having an upper member and a lower member, separated by a gap for the passage of the sheets to be machined. The upper frame member supports a punching head acting on a striker and a first plate of the turret, whereas the lower frame member supports an anvil and a second plate of this turret respectively, in opposing relationship. The first plate is provided with punches which are appropriately positioned and movable in axial direction when they are located selectively under the striker, whereas they are locked outside this region. The second plate, which is strictly in synchronism with the first, is provided with dies, which are perfectly positioned opposite the punches with which they are intended to co-operate.

The turret should be equipped with punches and dies corresponding to the holes to be cut in the sheet to be machined. Since the press is universal, in the sense that it should be able to machine any sheet, whatever the shape and dimensions of the holes, it is necessary to standardize the tools, each comprising a punch and a die such that, despite their extreme diversity, it is always possible to mount them in the turret without any adaptation.

It is the purpose of this standardization, firstly, that the tools occupy minimum space on the turret and, secondly, the punch and die equipment intended to form a set of tools requires keeping a minimum number of different parts in stock.

Thus, three sets of tools are generally provided and differ by the external diameter: small, medium and large. Naturally, the plates of the turret define small, medium and large housings adapted to these series.

According to a first known embodiment, the housings of the plates are distributed on a single circle, which is concentric to the axis of rotation of the turret and, in this case, the position of the striker relative to this axis is fixed. The drawback of this embodiment resides in the fact that there is a danger that the capacity of the turret as regards tools of small diameter will be insufficient and it is thus necessary to equip the press with a larger turret, which will only be used occasionally to full capacity. Now, an increase in diameter of the turret leads to a more bulky, stronger, more accurate and more difficult construction of the press.

According to a second known embodiment, the housings for the plates are distributed on three circles, which are concentric with the axis of rotation of the turret. The tool capacity of the latter is thus increased; but it is thus necessary that the punching head and its striker are adjustable radially relative to this axis. The result is clearly weakening of the strength of the press, decrease in the accuracy and an increase in the cost price.

It is the object of the invention to remedy these drawbacks, whilst facilitating an increase in the capacity of the turret as regards tools of small diameter, without modifying this turret, either from the point of view of its dimensions, or from the point of view of its operational equipment and without modifying the punching head, which remains fixed.

According to the invention, the punching or nibbling device comprises at least two modular series of tools each having a punch and a die, the tools of one series having an outer diameter different to that of the other series and all these tools being intended to be mounted selectively in two series of housings of varying diameters provided, at an equal distance from the axis of rotation of the turret, in a first plate of the latter for the punches and is a second plate for the dies, the punches also being movable longitudinally relative to their plate and able to be engaged by a member locking them in axial position, supported by the latter and co-operating selectively with a release mechanism located on a fixed part opposite the striker of the press, more precisely the invention resides in that the device also comprises a series of intermediate parts which are able to be substituted for the punches of large diameter and each define at least two housings of small diameter located side-by-side for mounting two punches of small diameter, in that the axes of the housings for all these intermediate parts are at the same distance from the axis of rotation of the first plate, in that the intermediate punch-support members, although able to slide in their housings, are permanently immobilized in the latter, in particular by the aforesaid locking members, on the other hand, in that the punches are able to slide in the housings of said intermediate parts and are retained by other locking members supported by the latter and co-operating with the aforesaid release mechanism, and in that the intermediate punch-support members are paired with intermediate die-support members intended to be mounted in the housings of large diameter in the second plate and define at least two housings for dies of small diameter paired with the aforesaid punches, these intermediate die-support members comprising the same positioning means as a die of large diameter relative to the second plate and as this second plate relative to the dies of small diameter.

Various other features and advantages of the invention will become apparent from the ensuing detailed description.

Figure 2:
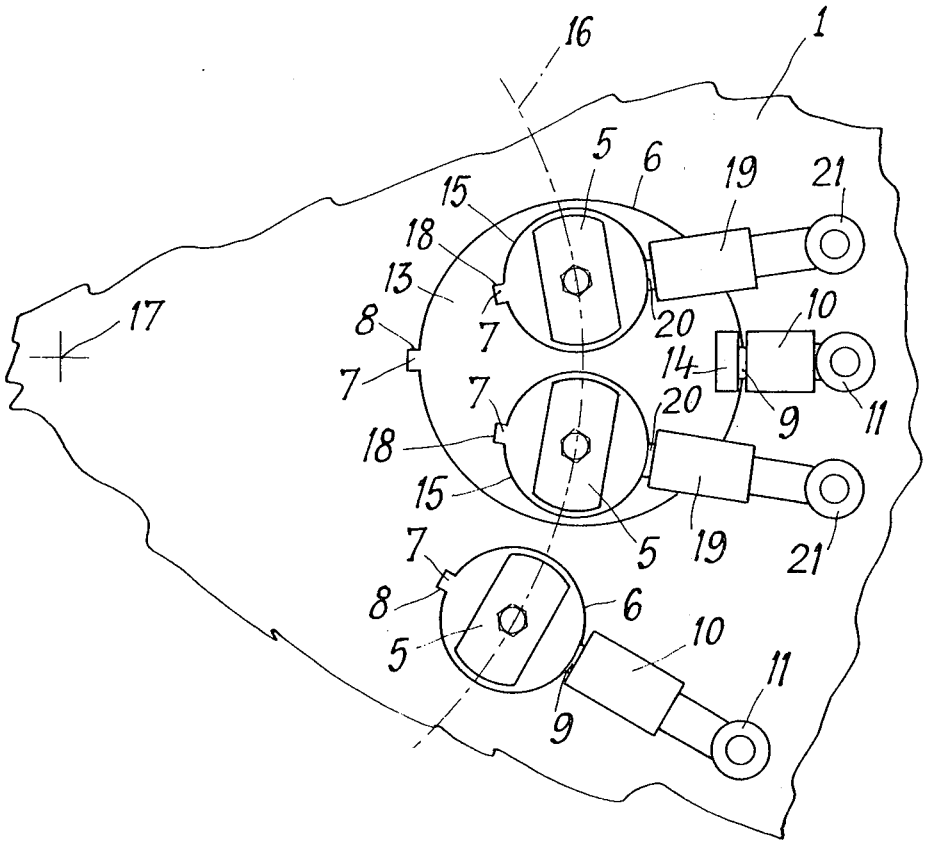
Figure 3:
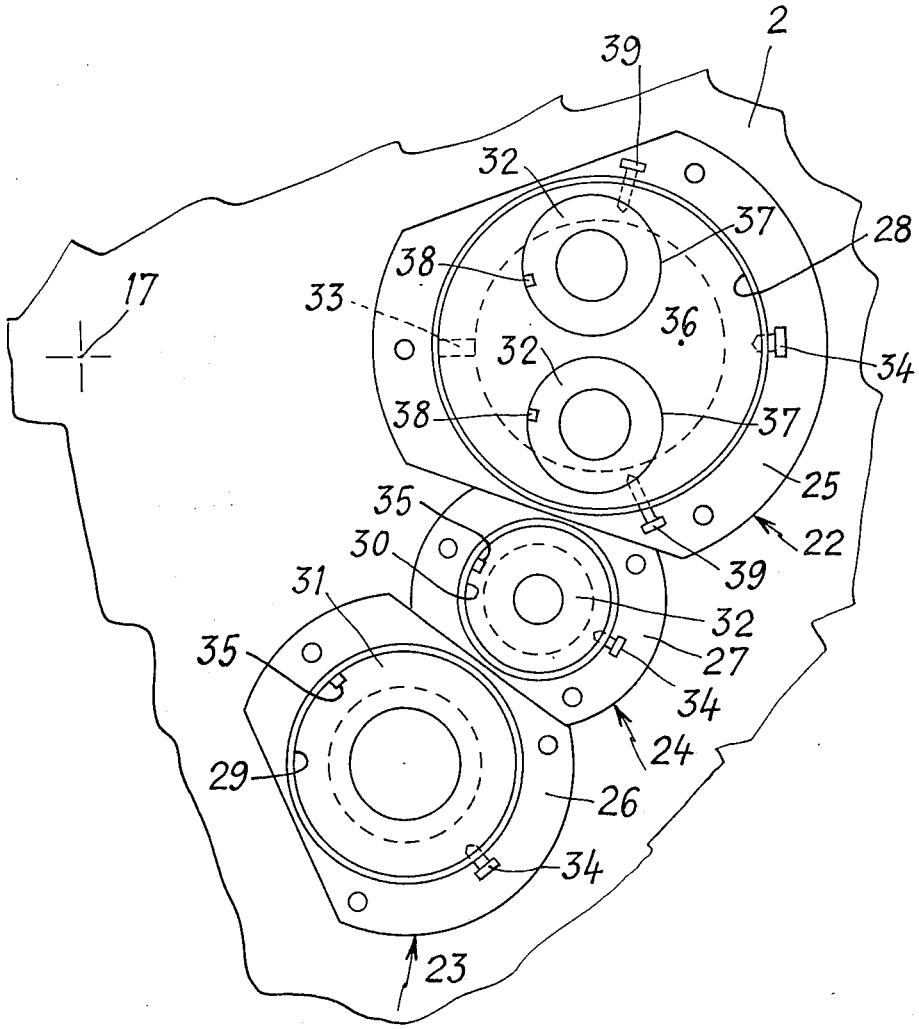

One embodiment of the object of the invention is illustrated, as a non-limiting example, in the accompanying drawings:

FIG. 1 is a plan view of a turret, whereof one of the sets of tools is making use of the invention, FIG. 2 is a partial plan view of the upper plate of the turret showing a punch member according to the invention, FIG. 3 is a partial plan view of the lower plate of the turret illustrating the corresponding die member.

The reference numerals 1 and 2 designate the upper and lower plate of a punching and/or nibbling press turret.

Punch members 3, 4, 5 respectively of large, medium and small diameters are normally mounted on the upper plate 1 (FIG. 1). Each punch member is disposed in a housing 6 of the same diameter provided in this plate and opening in the two sides of the latter. It is guided in translation in its housing, parallel to the axis of rotation of the turret, by means of a projecting tongue 7, introduced into a groove 8 in the plate or of a support, with which the latter is integral. It is also maintained in the retracted position by a finger 9, in order to keep the gap for the passage of the sheet completely free. The finger 9 is in fact radially movable in a support 10 of said plate and is subject to the action of a spring located inside this support in order to engage one of the ends of the finger in a locking hole provided in the punch member in question. The other end of the finger, located on the periphery of the plate 1, is provided with a loose roller 11, which, when coming close to the punching head, is engaged by a cam 12 positively causing the extraction of the finger from the locking hole and thus releasing the punch which may then be actuated by the striker.

According to the invention, each punch member 3 of large diameter may be replaced by an intermediate member 13 which is thus introduced into the corresponding housing 6 in the plate 1. This member is integral, on the one hand, with a tongue 7 guided in the groove 8 and, on the other hand, with a lug 14 comprising a locking hole for co-operating with the finger 9 associated with this housing 6.

The member 13 defines two housings 15 absolutely identical to the housing 6 of small diameter and located on the same circle 16, which is concentric with the axis 17 of the turret, as the housing 6 of all the members 3, 4, 5. These housings 15 are intended for mounting two punch members 5 (FIG. 2) whose tongues 7 are introduced into the grooves 18 of the member 13. Furthermore, the member 13 is integral with two supports 19 extending radially with respect to the axis of rotation 17 and intended to guide fingers 20, whereof one end co-operates with the locking holes of the punch members 5 mounted in the housings 15 and the other end of which is provided with a loose roller 21 located on the same circular trajectory as the rollers 11.

When the plate 1 does not contain sufficient punch members 5 (small diameter) and certain punch members 3 (large diameter) are not used, the latter are dismantled and intermediate members 13 are fitted in their housings until the supports 19 abut against the plate after locking the finger 9 in the lug 14; then, the additional punch members 5 (small diameter) are fitted in housings 15 in the members 13 until the fingers 20 are locked. When the turret rotates, the rollers 21, 11 and 21 (FIG. 2) are successively engaged by the cam 12, whose length is limited in order that when one finger 14 or 20 is unlocked, the other two fingers remain locked. Thus, a single punch of the member 13 may be released and simultaneously actuated by the striker.

Die members 22, 23, 24 respectively of large, medium and small diameter are normally mounted on the lower plate 2 (FIG. 3). These members comprise receptacles 25, 26, 27 having a flange, fixed to said plate such that the housings 28, 29, 30 which they define for large dies, average dies 31 and small dies 32 always have their axes in the housings 6 of the punch members 3, 4, 5. The large dies are positioned in the receptacles 22 by means of a radial groove fitting on a projecting tongue 33 and are immobilized by a locking screw 34. Similarly, the average dies 31 and small dies 32 are positioned in their receptacles 23 and 24 by means of an axial groove fitting on a projecting tongue 35 and are immobilized by a locking screw 34.

According to the invention, each die of large diameter may be replaced, in the corresponding receptacle 25, by an intermediate member 36 which, to this end, has the same diameter as the housing 28, defines a groove which may be fitted on the positioning tongue 33 and is able to be immobilized by the locking screw 34.

The member 36 comprises two housings 37 which are absolutely identical to the housings 30 of small diameter and located directly opposite the housings 15 provided in the corresponding member 13. Dies 32 (of small diameter) paired with the punch members 5 of this member 13 are mounted in these housings 37. They are fitted on projecting positioning tongues 38 integral with the member 36 and are immobilized by locking screws 39.

Naturally, as above-mentioned, when a punch member 3 is replaced by an intermediate member 13 and two punch members 5, it is necessary to replace the corresponding die arrangement 22 by an intermediate member 36 and the paired dies 32.

The punching device described above to illustrate the invention thus comprises, not only three sets of tools 3 and 22, 4 and 23, 5 and 24, but also a series of intermediate members 13 and 36 for substituting two small sets for each large set of tools.

The invention is not limited to the embodiment illustrated and described in detail, since various modifications may be applied thereto without diverging from its framework.

The device, which is the object of the invention, may be applied to punching and nibbling presses having a turret.

What is claimed is:

1. Punching and nibbling device for a press comprising a turret, having at least two modular series of tools each comprising a punch and a die, the tools of one series having an external diameter different from that of the other series and all these tools being intended to be mounted selectively in two series of housings of different diameters, provided, at an equal distance from the axis of rotation of the turret, in a first plate of the latter for the punches and in a second plate for the dies, the punches also being longitudinally movable relative to their plate and able to be engaged by a locking member in the axial position, supported by the latter and co-operating selectively with a release mechanism located on a fixed part opposite the striker of the press, said device also comprising:

a series of intermediate members which are able to be substituted for the punches of large diameter and each define at least two housings of small diameter located side by side for mounting two punches of small diameter, the axes of the housings of all these intermediate members being at the same distance from the axis of rotation of the first plate, the intermediate punch-support members, although able to slide in their housings, being immobilized in the latter, in particular by the aforesaid locking members, said punches being able to slide in housings in said intermediate members and being retained by other locking members supported by the latter and co-operating with the aforesaid release mechanism, and the intermediate punch-support members being paired with intermediate die-support members intended to be mounted in housings of large diameter in the second plate and defining at least two housings for the dies of small diameter paired with the aforesaid punched, these intermediate die-support members comprising the same positioning means as a die of large diameter relative to the second plate and as this second plate relative to the dies of small diameter.

2. Device according to claim 1 in which the locking means supported by the intermediate members for immobilizing the punches rest on the first plate in order to oppose the displacement of these members.

3. In a punch press apparatus having indexible turret means, and housings in said turret means disposed to carry punch sets and die sets of designated sizes, the improvement which comprises a first intermediate member inserted into a housing of the turret means designated for a punch set of a given size; means in said first intermediate member defining a plurality of housings each disposed to receive and carry a punch set of smaller size; a second intermediate member inserted into a housing of the turret means designated for a die set of size matching said given size punch set; means in said second intermediate member defining a plurality of housings each disposed to receive and carry a die set of smaller size.

* * * * *